US007741553B2

(12) United States Patent
Nishida

(10) Patent No.: US 7,741,553 B2
(45) Date of Patent: Jun. 22, 2010

(54) WHITE KEY FOR KEYBOARD MUSICAL INSTRUMENT

(75) Inventor: Kenichi Nishida, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/256,724

(22) Filed: Oct. 23, 2008

(65) Prior Publication Data

US 2009/0100987 A1 Apr. 23, 2009

(30) Foreign Application Priority Data

Oct. 23, 2007 (JP) ..... 2007-275338

(51) Int. Cl.
*G10D 13/02* (2006.01)

(52) U.S. Cl. ..... 84/433; 84/423 R

(58) Field of Classification Search ..... 84/430–436, 84/423 R

See application file for complete search history.

(56) References Cited

U.S. PATENT DOCUMENTS 3,979,990 A * 9/1976 Hinago ..... 84/719
6,051,768 A * 4/2000 Masubuchi ..... 84/433
2006/0219085 A1* 10/2006 Kamijima et al. ..... 84/438
2008/0066608 A1* 3/2008 Osuga ..... 84/423 R

FOREIGN PATENT DOCUMENTS

JP 2000-132168 5/2000
JP 2003-271127 9/2003

* cited by examiner

*Primary Examiner*—Kimberly R Lockett
(74) *Attorney, Agent, or Firm*—Morrison & Foerster LLP

(57) ABSTRACT

A white key for a keyboard musical instrument comprises a key body made of resin in the form of a hollow box shape having an upper wall to be pressed by an instrument player and vertical walls extending downward from the periphery of the upper wall. The upper wall of the key includes a wide part and a narrow part, the narrow part providing a space to accommodate a black key. The upper wall has a thickness not exceeding 1.5 mm and the wide part has a projection extending from the upper wall downward. The projection may be in the form of a rib bridging the vertical walls or of columns extruding from the lower surface of the upper wall. The frequency band of a vibration mode due to a deformation of the upper wall caused when struck by the player's finger is shifted higher when compared with the case where no projection is provided.

6 Claims, 12 Drawing Sheets

Bottom View of White Key

Plan View of White Key

Plan View of Integral Unit of White Keys

Side View of White Key

Side Sectional View of White Key

Bottom View of White Key

Side Sectional View of White Key

Bottom View of White Key

Side Sectional View of White Key

Bottom View of White Key

Perspective View for Measuring Vibration Characteristics

Perspective View of Simulation Model (Control)

Perspective View of Simulation Model (Invention)

Excitation Characteristic of Impact Hammer

Vibration Characteristic of White Key

Vibration Characteristic of White Key

Vibration Characteristic of White Key

Vibration Characteristic of White Key

Vibration Characteristics of White Key

WHITE KEY FOR KEYBOARD MUSICAL INSTRUMENT

TECHNICAL FIELD

The present invention relates to a white key for a keyboard musical instrument in which the key body is formed of resin in a small thickness but is contrived to damp the click noise caused by a clash between the white key and the nail of the player.

BACKGROUND INFORMATION

Electronic keyboard musical instruments and the like keyboard musical instruments generally employ playing keys made of resin or plastics. A key made of resin is generally formed in a shape of a hollow box having a horizontal upper wall to be pressed by the finger of the player and vertical walls including a front wall, two side walls and a rear wall extending downward from the periphery of the upper wall to surround an open space therein. A plastic key can therefore be manufactured easily and inexpensively when compared with a traditional key (such as of a piano) which comprises a core bar made of wood and surface plates made of plastics or ivory adhered on the wooden core.

However, a plastic key of a hollow box shape has a drawback, in comparison with a wood-core key of a solid body, of generating harsh click noises caused by the clashes between the key top (horizontal upper wall) and the nail and resonating in the hollow box structure when the key is struck by the player's finger. In particular, a white key which has a larger surface area for key depression than a black key tends to generate louder click noises, much more does a white key having thinner plastic walls for the purpose of decreasing the weight and the manufacturing cost of the keyboard assembly.

A keyboard is a main input device for playing music on a keyboard musical instrument, and accordingly the keys constituting the keyboard are required to be of high quality and a high grade. But a harsh or ear-annoying clash noise between the key top and the nail would give an impression of a cheap musical instrument. Further, in the case of an electronic musical instrument on which the player is playing music using a headphone or an earphone, the musical tones can be heard only by the player and not by the persons near the player, and consequently only the clash noises would reach conspicuously to the ear of the persons present nearby.

Unfortunately, however, there has been known no technique of taking countermeasures against such nail clashing noises. The technique disclosed in an unexamined Japanese patent publication No. 2000-132168 is to utilize cushion materials disposed between the screw heads and the key bed when the keyboard assembly is fixed to the key bed in the electronic piano in order to absorb the vibration of the keyboard assembly generated by the key depression and to prevent the vibration from being propagated to the key bed. The technique is for suppressing the noises produced by the vibrations of the key bed at the times the keys are depressed, and does not work as a countermeasure against the clash noises between the key and the nail.

The technique disclosed in a registered Japanese patent publication No. 3758590 is to manufacture a key by forming the portion which serves as a swing fulcrum of the key by resin and forming the front body part by wood in order to increase the preciseness of the connecting portion to serve as the swing fulcrum as well as obtain the appearance and the rigidness of the wood material. As this technique utilizes wood material, the manufacturing cost will be almost the same as the conventional wooden key.

SUMMARY OF THE INVENTION

In view of the foregoing circumstances, therefore, it is a primary object of the present invention to obviate the above-mentioned drawback residing in the conventional plastic keys and to provide a white key made of resin material as a whole for keyboard musical instruments, in which the thickness of the key body is decreased for the purpose of decreasing the weight and the manufacturing cost of the key and yet the clash noise between the key top and the nail is suppressed from generating and resonating harshly to sound soft at the time the key is struck by a finger.

According to the present invention, the object is accomplished by providing a white key for a keyboard musical instrument comprising: a key body made of resin in the form of a hollow box shape having an upper wall to be pressed by an instrument player and vertical walls extending downward from the periphery of the upper wall, wherein the upper wall of the key includes a wide part and a narrow part, the narrow part providing a space to accommodate a black key to be interposed between two white keys, and wherein the upper wall has a thickness not exceeding 1.5 mm and the wide part has a projection extending from the upper wall downward.

The projection downwardly extending from the upper wall serves to change the vibration characteristics (the natural frequency and the mode of vibration) of the key body, and in particular the provision of the projection to the wide portion (having a large area) of the key wall will effectively influence the characteristics. Thus, the annoying harsh clash noises due to the striking nails will be suppressed and the tone quality of the sound generated by the key itself will be improved. Consequently, even though the thickness of the upper wall which would otherwise require to be thick to constitute the wall to be struck by the player's finger can be 1.5 mm or less, with the nail striking noises being suppressed to a tolerable degree. This will help in decreasing the weight and the manufacturing cost of the key and in improving the sound quality at the time of the key depression.

In an aspect of the present invention, the projection may be in the form of a rib. The rib serves to reinforce the struck wall in its longitudinal direction to provide a robust key exhibiting a minimal bend or twist.

In another aspect of the invention, the rib may be integrally formed with the key body extending in the longitudinal direction of the key body. As the key is manufactured by injecting plastic resin into a mold and the resin flows along the longitudinal direction in the mold, the longitudinally extending mold cavity will help smooth flow of the resin in the mold cavity, which will present a smooth surface of the product. On the contrary, if the rib is provided lying in the transverse direction, the flow of the resin in the mold cavity may be turbulent in the rib area and may degrade the smoothness of the surface of the product or may cause a flow mark to deteriorate the appearance of the key.

In still another aspect of the present invention, the rib may be provided to have a frequency band of a vibration mode due to a deformation of the upper wall when pressed by the user so that the frequency band is shifted toward the higher frequency side as compared with the case where the upper wall has no projection. In such a way, the frequency band of the mode of vibration of the upper wall of the key body which would make a conspicuous harsh noise at the nail strike on the wall which has a thickness of 1.5 mm or less will be shifted toward a higher frequency, which in turn suppress the strike noise from sounding harshly.

The frequency of the vibration mode of the upper wall may preferably lie in the range of 1 kHz-2 kHz. As the harsh annoying noise of the nail clash onto the key wall generally is due to the frequency components of the vibration mode lying in the range of 1 kHz-2 kHz, shifting the frequency components in that range toward higher frequency side will suppress such a harsh annoying noise. For the similar reason, the rib may preferably be formed to cause a decrease of an acceleration peak value of the vibration mode of the upper wall of the range between 1 kHz and 2 kHz. This will also suppress a harsh annoying noise.

In a further aspect of the present invention, the white key has a swing fulcrum at its rear end, and a plurality of white keys may preferably be connected with each other by a rear connecting member behind the swing fulcrums to form a unit of white keys. This structure will be advantageous in fixing the white keys to the keyboard assembly unit by unit. The white keys which have different shapes in association with the interposed black keys can thus be positioned easily in the exact arrangement by simply placing the unit on the keyboard frame, which will enormously simplify the assembling process. This will reduce the manufacturing cost in addition to the cost reduction by saving the resin material.

BRIEF DESCRIPTION OF THE DRAWINGS

For a better understanding of the present invention, and to show how the same may be practiced and will work, reference will now be made, by way of example, to the accompanying drawings, in which.

DETAILED DESCRIPTION OF EMBODIMENTS OF THE INVENTION

Figure 1A:
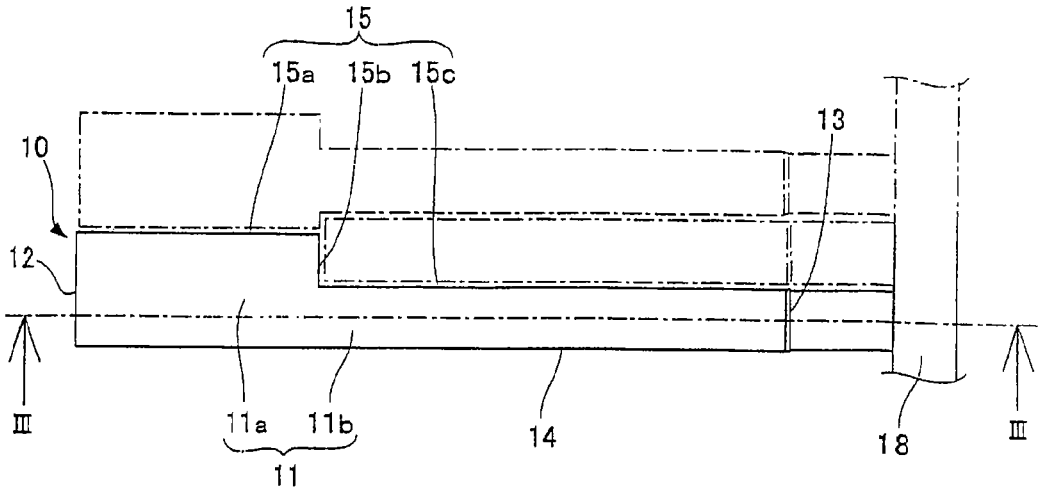
FIGS. 1*a* and 1*b* are plan views of a white key for a keyboard musical instrument according to an embodiment of the present invention, FIG. 1*a* showing a white key in association with a black key and another white key, both in phantom line, and FIG. 1*b* showing a plurality of white keys connected together by a connecting member at their rear ends to make an integral unit.

The invention and its various embodiments can now be better understood by turning to the following detailed description of the preferred embodiments with reference to the accompanying drawings.

It should be expressly understood that the illustrated embodiments are presented just as practicable examples of the invention and that the invention as defined by the claims may be broader than the illustrated embodiments described below. In the drawing, like reference characters refer to like parts so that repetitive explanations may be omitted. The term "front" will be used herein to denote the area or part of a key which is near to the player of the keyboard musical instrument where the keyboard is assembled in the instrument, and the term "rear" to denote the area or part which is far from the player. The term "white key" will be used to denote a key which is assigned to a natural note as opposed to a black key which is assigned to a sharp (or flat) note. It should therefore be understood that the actual color of the white key may not necessarily be literally "white," and may be of another color which can be differentiated from the black key in hue, chroma (saturation) or lightness. It is well known in the art that a traditional harpsichord has white keys in the color of "black" and black keys in the color of "white."

Figure 1B:
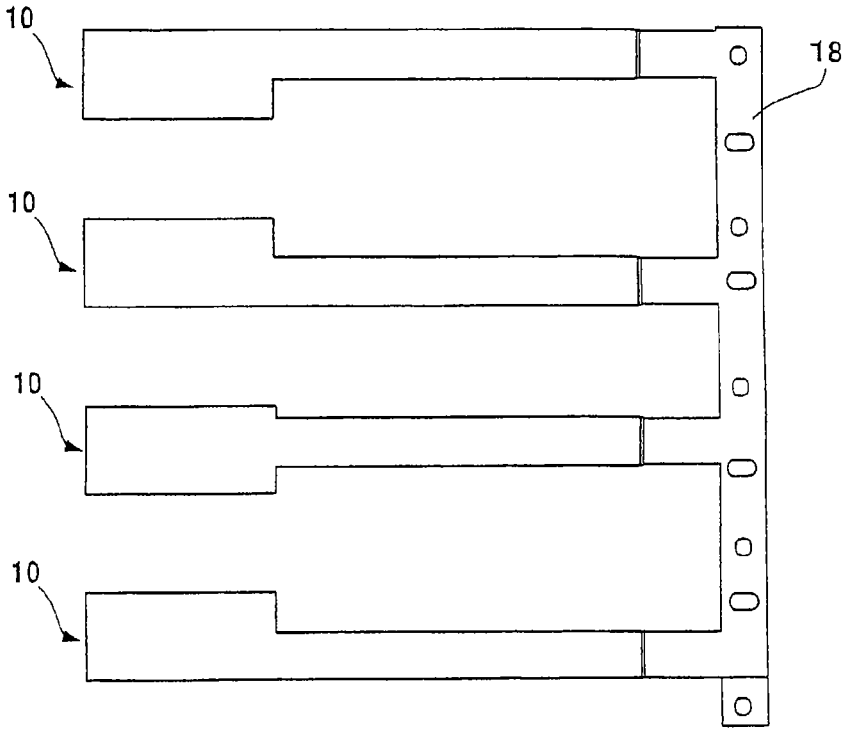
Figure 2:
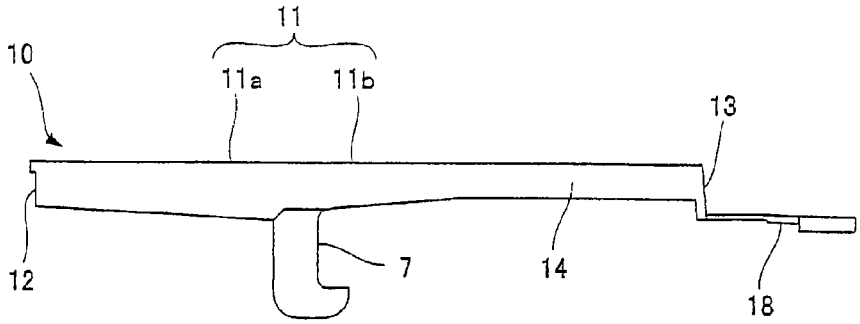
FIG. 2 is a side view of the white key shown in FIG. 1*a* or 1*b;*
Figure 3:
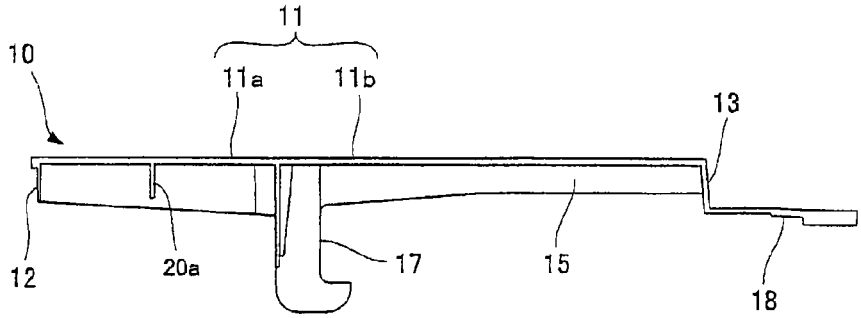
FIG. 3 is a side sectional view of the white key taken along the line as viewed in the direction of the arrows III-III in FIG. 1*a;*
Figure 4:
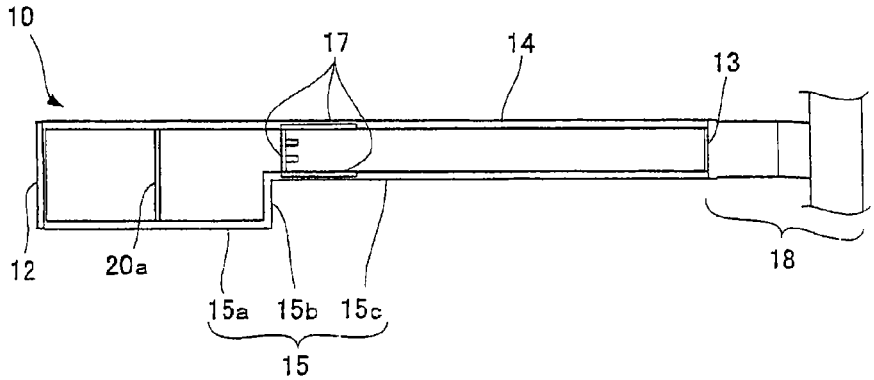
FIG. 4 is a bottom view of the white key shown in FIG. 1*a;*

A white key or keys of an embodiment of the present invention are shown in FIGS. 1*a* through 4, FIGS. 1*a* and 1*b* being plan views, FIG. 2 a side view, FIG. 3 a side sectional view taken along the line III-III in FIG. 1*a*, and FIG. 4 a bottom view. FIG. 1*a* shows a white key for a keyboard musical instrument according to an embodiment of the present invention in solid lines in association with an adjacent black key and a further adjacent white key in dot-dash phantom lines, and FIG. 1*b* shows a plurality of white keys connected together at their rear ends to make an integral unit.

As shown in FIGS. 1*a* and 2-4, the white key for a keyboard musical instrument is formed with a key body 10 made of resin in the form of a hollow box shape which has an upper wall 11 to be pressed by an instrument player, a front wall 12 facing toward an instrument player, a rear wall 13 opposite to the front wall 12 and two side walls 14 and 15, the latter four walls vertically extending downward from the periphery of the horizontal upper wall 11. The side wall 14 extends straight from the front to the rear, and the side wall 15 consists of a front-part side wall 15*a*, a crank-part side wall 15*b* and a rear-part side wall 15*c* to provide a stepped space to accommodate an adjacent black key to be interposed between two white keys. Accordingly, the upper wall 11 comprises a wide part 11*a* of an area delimited by the side wall 14 and the front-part side wall 15*a*, and a narrow part 11*b* of an area delimited by the side wall 14 and the rear-part side wall 15*c*, the wide part 11*a* constituting a key top to be primarily pressed by the finger of the instrument player. Near the front end of the narrow part 11*b* is provided an actuator 17 extending from the upper wall 11 downward. The lower end of the actuator 17 is formed with a hook member which engages with an upper limit stopper fixed to a key frame (not shown) to define the uppermost position of the key at the non-depressed state. In the embodiment, a plurality of white keys are formed integrally with a rear connecting member 18 to make an assembled unit by plastic molding, so that the white key can be put together in a keyboard assembly in a unit-by-unit manner. The resin used for forming the key body 10 having the integral walls may preferably be styrene family plastic such as AS (acrylonitrile-styrene copolymer) and ABS (acrylonitrile butadiene styrene resin) which are widely used in manufacturing plastic keys for keyboard musical instruments.

Under the wide part 11*a* of the upper wall 11 is formed a planar projection 20*a* in the form of a rib extending transversely from the side walls 14 and 15*a*. The planar projection 20*a* is formed integrally with the key body 10 by plastic molding to connect the side wall 14 and the front-part side wall 15*a*. The planar projection 20*a* influences or alters the vibration characteristics (the natural frequency of vibration and the mode of vibration) of the key body 10. More specifically, the planar projection 20*a* is designed and provided so that the frequency band of the mode of vibration due to the deformation of the upper wall 11 when struck by the finger is shifted toward the higher frequency side as compared with the case where the projection is not provided on to the upper wall 11 and so that the acceleration peak value of the vibration mode of the upper wall 11 is decreased. The planar projection 20*a* provided to the wide part 11*a* having a large area can effectively modify the vibration characteristics. As a result, the clicking harsh noise generated when the nail clashes or knocks on to the upper wall 11*a* will be suppressed, so that the tone quality of the sound generated by the key body 10 itself at the key strike will be improved. This effect of decreasing the nail clashing noises will make it possible to thin the walls of the key body 10, in particular the upper wall 11 which is most influenceable, for example, down to 1.0 through 1.5 mm, still keeping the nail clashing harsh noises suppressed. The front wall 12, the rear wall 13 and the side walls 14, 15 can be thinned to the same degree or more as long as the necessary structural strength can be obtained.

Figure 5:
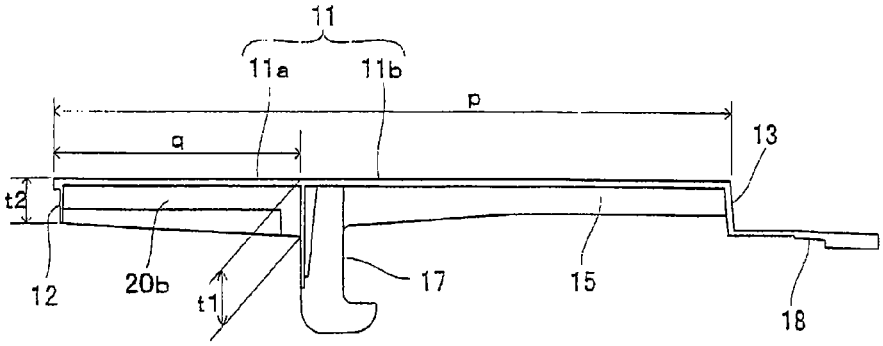
FIG. 5 is a side sectional view of a white key for a keyboard musical instrument according to another embodiment of the present invention.
Figure 6:
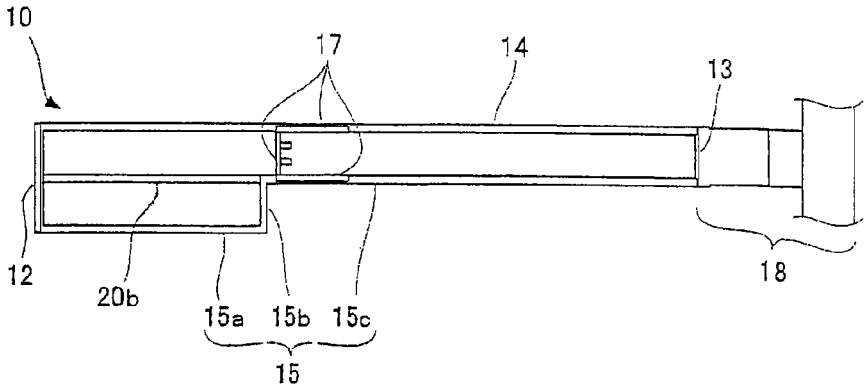
FIG. 6 is a bottom view of the white key shown in FIG. 5.

FIGS. 5 and 6 show a white key for a keyboard musical instrument according to another embodiment of the present invention, FIG. 5 being the side sectional view and FIG. 6 being the bottom view. The key body 10 of this embodiment comprises the same walls 11, 12, 13, 14 and 15 as the key of the embodiment of FIG. 1*a*, and in addition thereto, a planar projection 20*b* in the form of a rib extending in the longitudinal direction of the key body 10 under the wide part 11*a*. The planar projection 20*b* is formed integrally with the key body 10 by plastic molding, connecting or bridging the lateral center of the front wall 12 and the transition corner between the crank-part side wall 11*b* and the rear-part side wall 11*c*.

As with the case of the preceding embodiment, this embodiment also will suppress the generation of clicking harsh noises caused by the nail clashes, improving the tone quality of the sound generated by the key body 10 itself at the key strike. Also with this embodiment, the effect of decreasing the nail clashing noises will make it possible to thin the walls of the key body 10. This embodiment will be particularly advantageous in plastic molding, as the planar projection 20*b* is provided in the form of a rib extending in the longitudinal direction of the key body 10. More specifically, in the plastic molding process of the key, the resin flows in the mold mainly along the longitudinal direction of the key body 10, and the resin for forming the projection 20*b* will accordingly flows through the cavity for the rib, while the cavity lies in the longitudinal direction, which therefore causes a smooth flow of the resin in the cavity. This will provide a smooth surface of the molded product, and accordingly prevent rough surfaces and flow marks due to the turbulence of the resin flow in the mold.

Figure 7:
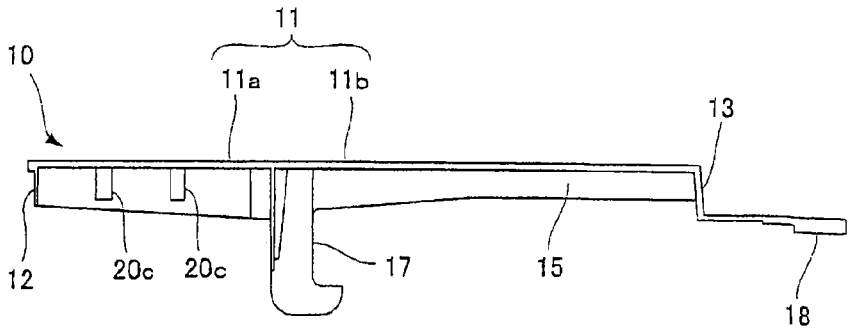
FIG. 7 is a side sectional view of a white key for a keyboard musical instrument according to a further embodiment of the present invention.
Figure 8:
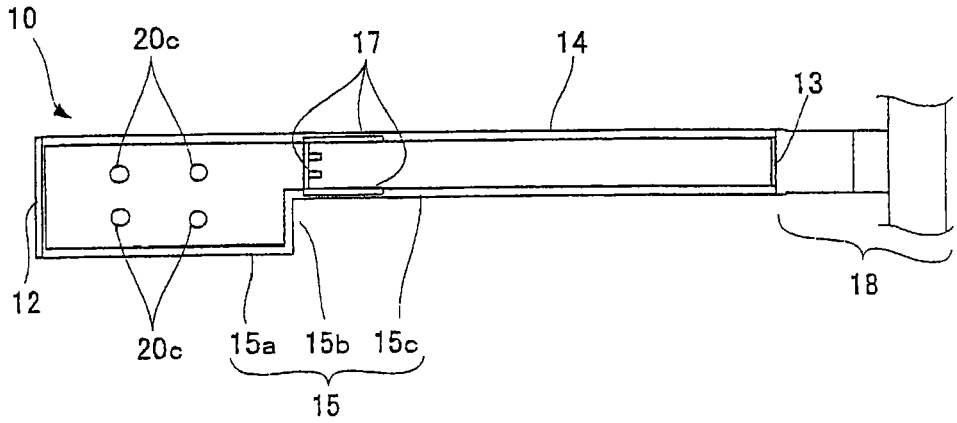
FIG. 8 is a bottom view of the white key shown in FIG. 7.

FIGS. 7 and 8 show a white key for a keyboard musical instrument according to a further embodiment of the present invention, FIG. 7 being the side sectional view and FIG. 8 being the bottom view. The key body 10 of this embodiment also comprises the same walls 11-15 as the keys of the previous embodiments. Under the wide part 11*a* of the upper wall 11, there are provided columnar projections 20*c* which are spaced apart from each other. The columnar projections 20*c* are formed integrally with the key body 10 by plastic molding, protruding downward from the lower surface of the wide part 11*a*.

As with the case of the preceding embodiment, this embodiment also will suppress the generation of clicking harsh noises caused by the nail bumps on to the key top surface, improving the tone quality of the sound generated by the key body 10 itself at the key strike. Also with this embodiment, the effect of decreasing the nail bumping noises will make it possible to thin the walls of the key body 10. This embodiment will be particularly advantageous in plastic molding, as the projections 20*c* are provided in the form of separate columns protruding perpendicularly to the undersurface of the wide part 11*a* of the upper wall 11. More specifically, in the plastic molding process of the key, the resin flows will not be obstructed so much in the mold, which will accordingly provide a smooth surface of the molded product.

An explanation will now be made about the evaluation of vibration characteristics of a white key according to the present invention. The evaluation was conducted in the following way.

(1) A white key made with thick walls and a white key made with thin walls were compared auditorily.

(2) The vibration characteristics of a white key made with thick walls and of white keys made with thin walls were measured.

(3) The vibration characteristic of a simulation model of a white key having thin walls is analyzed.

(4) The vibration characteristic of a simulation model of a white key having thin walls and provided with a projection is analyzed.

The white keys used for measurement had external dimensions of 140 mm in total length and 21.4 mm in width, in common. The other main dimensions are different from one model to another as shown in Table 1, wherein "t1" denotes the side wall height at the actuator end and "t2" denotes the side wall height at the front end as depicted in FIG. 5. The values shown are just for examples and do not mean to limit the invention.

TABLE 1

| | Key N of Ordinary Thickness | Key A With Thin Wall | Key BWith Thin Wall | Key C With Thin Wall |
|---|---|---|---|---|
| t1: Side Wall Height at the Actuator End in [mm] | 11.4 | 8.5 | 8.5 | 7.8 |

TABLE 1-continued

| | Key N of Ordinary Thickness | Key A With Thin Wall | Key BWith Thin Wall | Key C With Thin Wall |
|---|---|---|---|---|
| t2: Side Wall Height at the Front End in [mm] | 9 | 9 | 7 | 5 |
| Thickness of the Upper Wall in [mm] | 2 | 1.2 | 1.2 | 1.2 |

Figure 9:
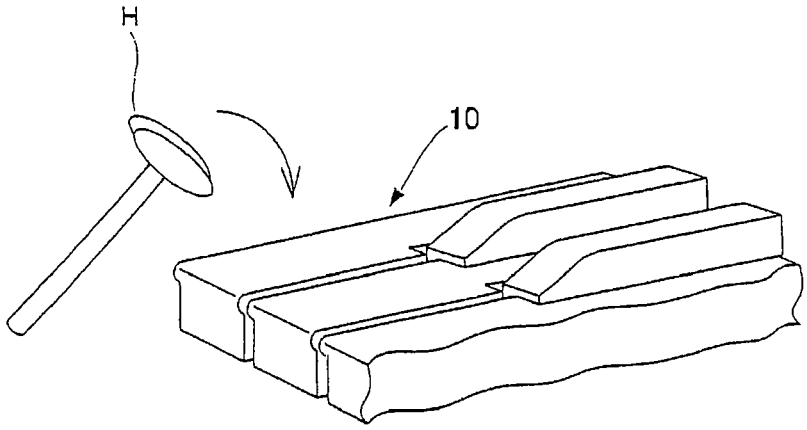
FIG. 9 is a perspective view for showing a method of measuring the vibration characteristics of the white key.

FIG. 9 shows diagrammatically a method for measuring the vibration characteristics of the white key. In this method, a keyboard assembly including white keys respectively having the above-mentioned specifications was provided, an acceleration sensor was fixed at the position 25 mm from the front end of each white key to be measured, an impact hammer H stroke the vicinity of the sensor, and the acceleration sensor measured the frequency response of the key vibration.

Figure 12:
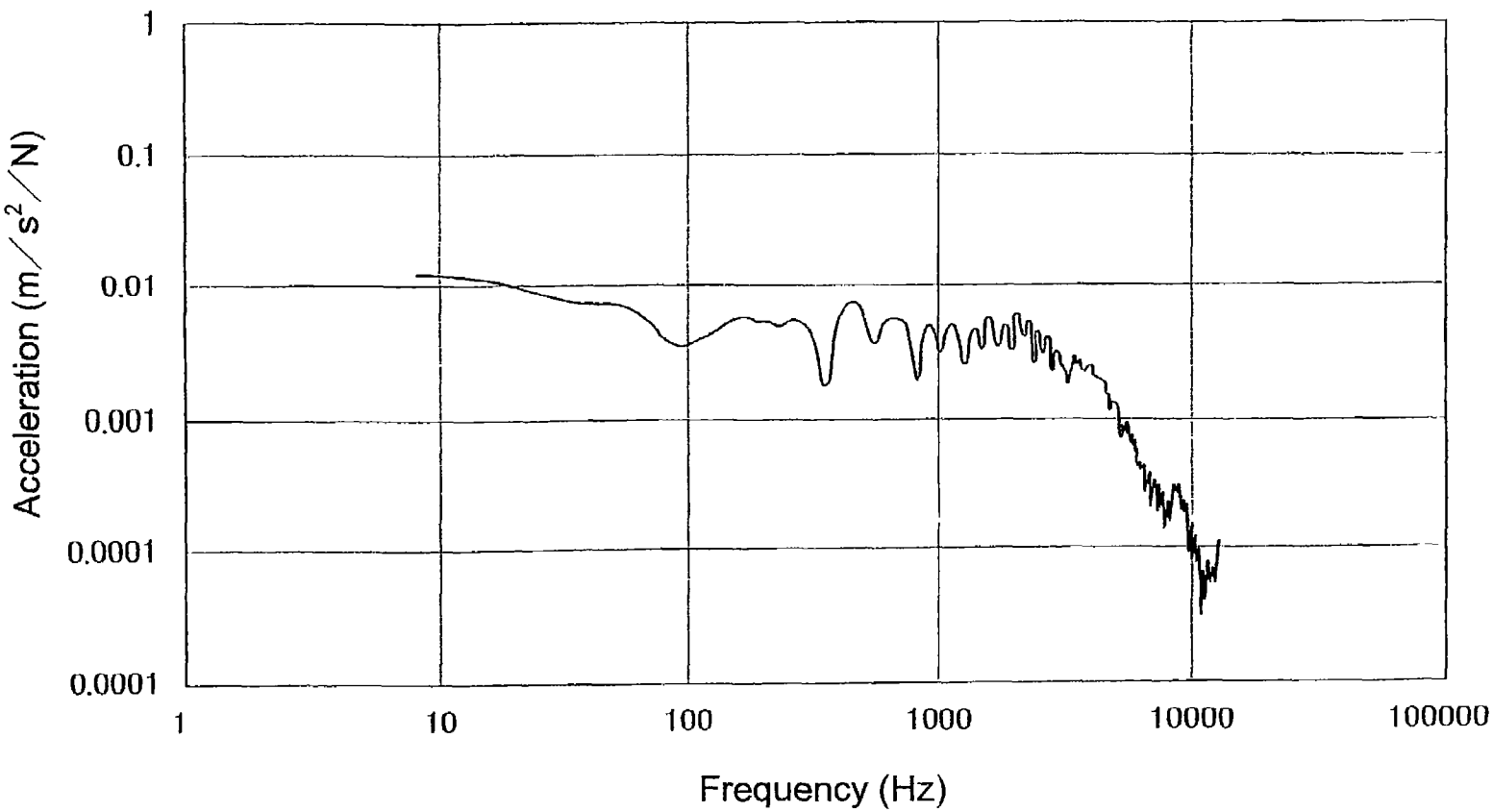
FIG. 12 is a graph showing an excitation characteristic of an impact hammer used for the measurement for evaluating the vibration characteristics of a white key.

As preparation for the measurements, the input characteristics of the key strikes by the impact hammer H were measured. FIG. 12 shows a graph (both the abscissa and the ordinate are in a logarithmic scale) representing the frequency characteristics of the acceleration of the impact hammer H in terms of the reaction force received by the impact hammer H itself at the time of the key strike. The graph shows a roughly flat frequency characteristic in the range of about 10 Hz through about 3000 Hz, which evidences that the excitation characteristic of the impact hammer H is fairly flat in this frequency range.

The result of the evaluation is as follows.

(1) Auditory Comparison Between a White Key Made with Thick Walls and White Keys Made with Thin Walls:

Each of the white key N having thick walls and the white keys A, B and C was struck by a finger, and the click noise generated when the nail clashed or knocked on to the key was evaluated auditorily, and the result was that the nail clashing noises sounded piercingly sharp in the cases of the white keys A, B and C as compared with the key N having walls of an ordinary thickness.

Figure 13:
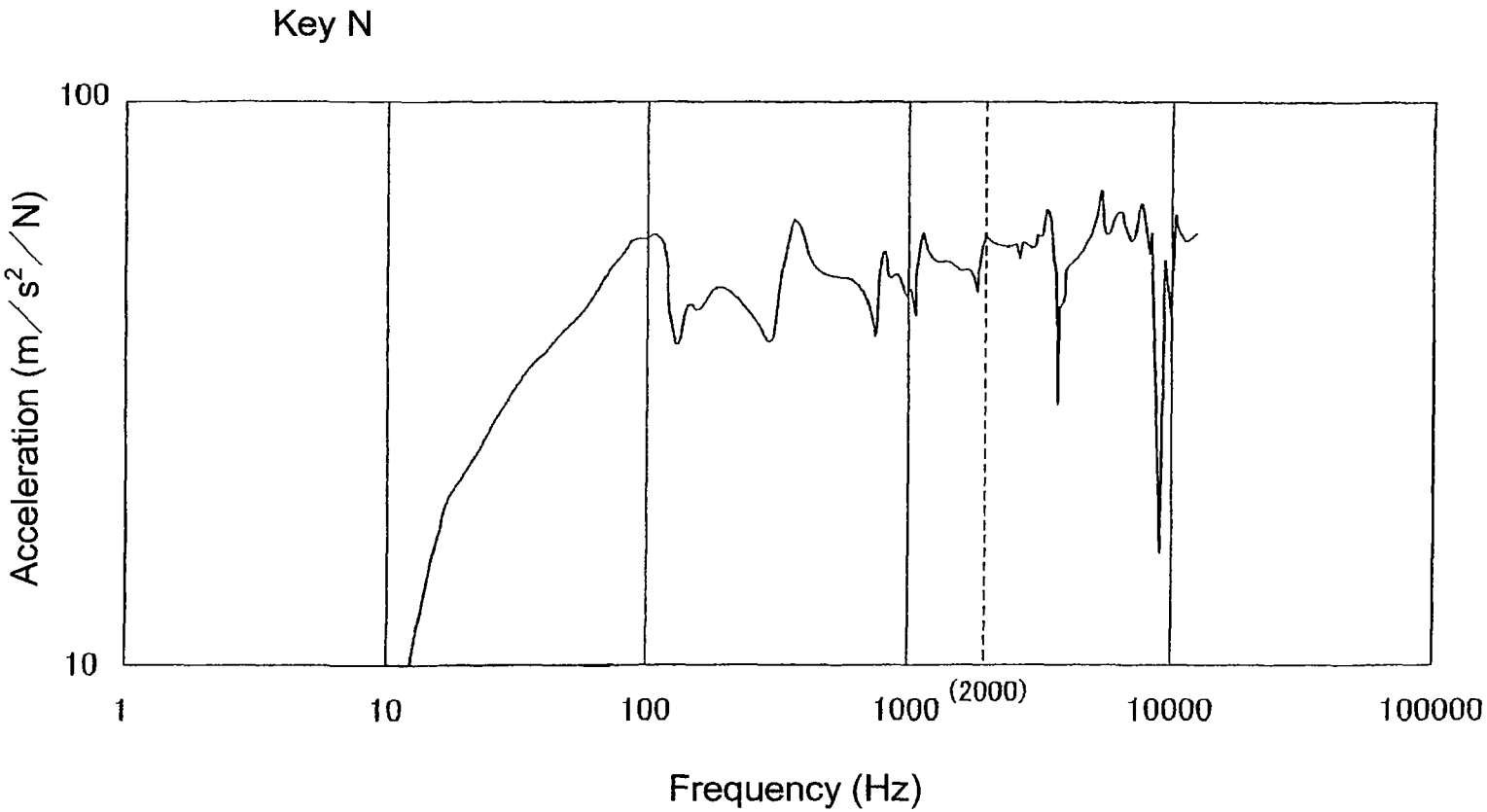
FIG. 13 is a graph showing a vibration characteristics measured of a white key having an ordinary wall thickness.
Figure 14:
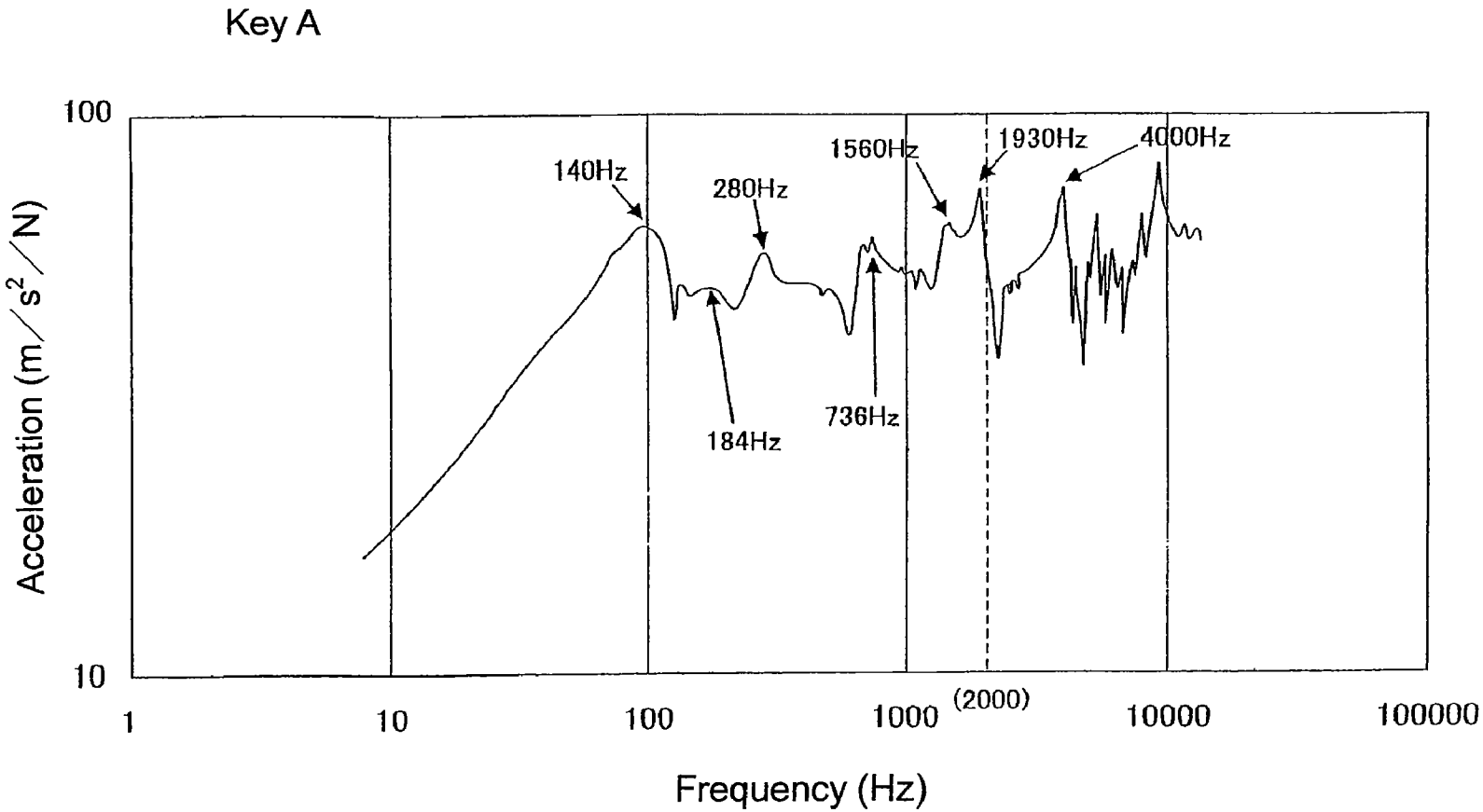
FIG. 14 is a graph showing a vibration characteristics measured of a white key of an example having a small wall thickness.
Figure 15:
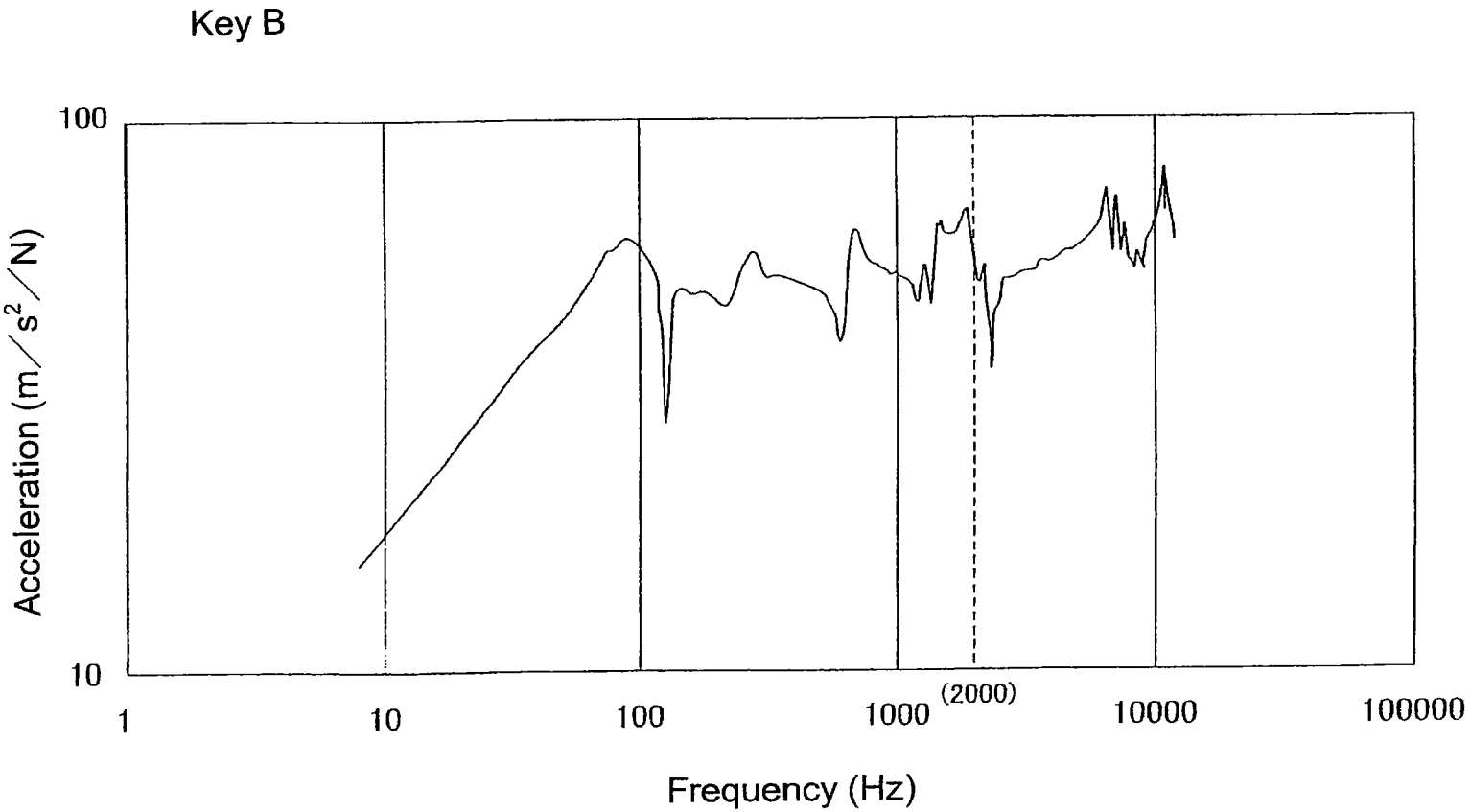
FIG. 15 is a graph showing a vibration characteristics measured of a white key of another example having a small wall thickness.
Figure 16:
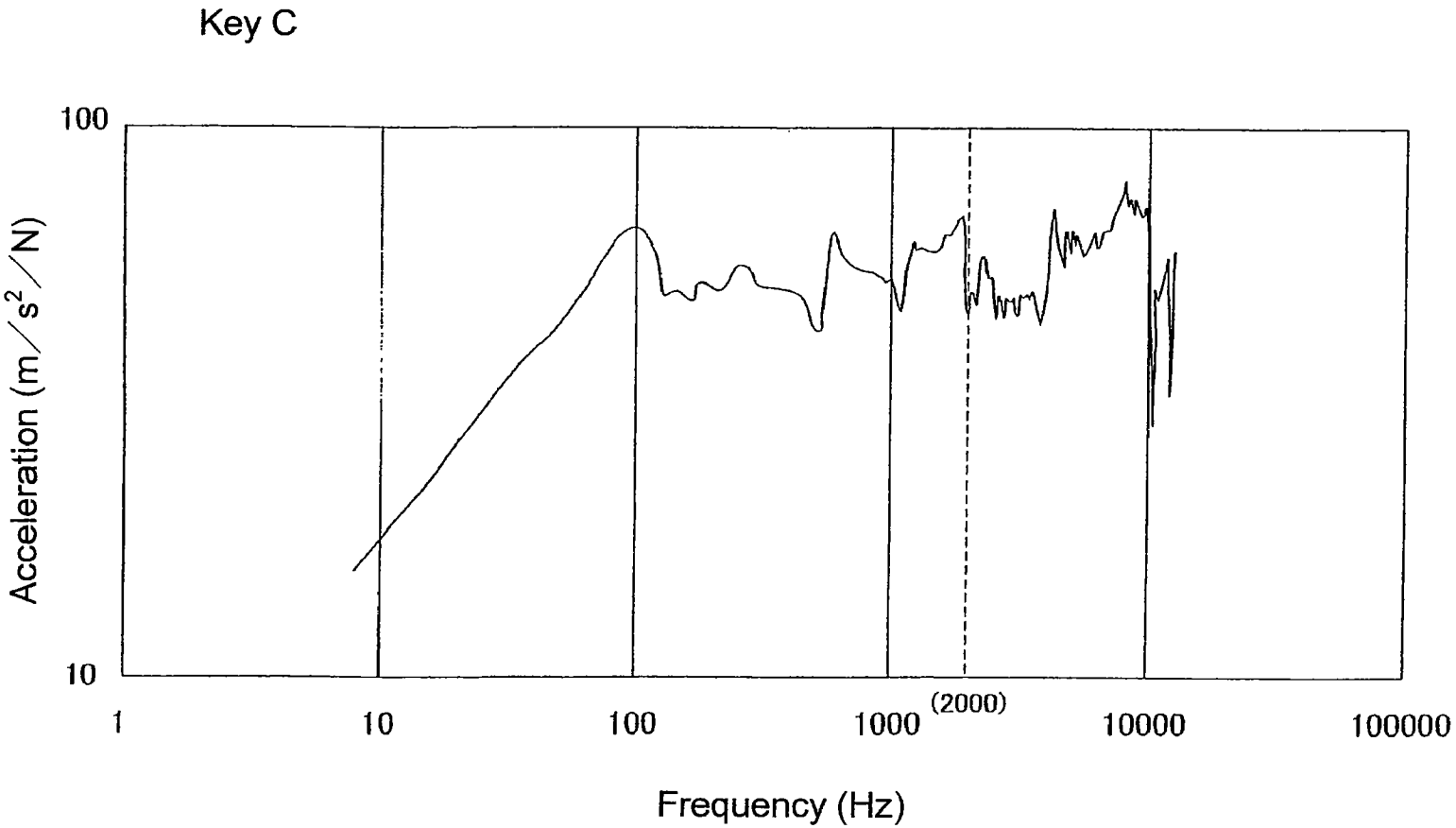
FIG. 16 is a graph showing a vibration characteristics measured of a white key of still another example having a small wall thickness.

(2) Measurement of the Vibration Characteristics of a White Key Made with Thick Walls and White Keys Made with Thin Walls:

Each of the white key N having thick walls and the white keys A, B and C was struck by an impact hammer H, and the frequency response characteristic of each key is measured. The results of the measurements are shown in the graphs in the drawings, in which FIG. 13 shows the acceleration response with respect to frequency of the key N, FIG. 14 of the key A, FIG. 15 of the key B and FIG. 16 of the key C. Both the abscissa and the ordinate are in a logarithmic scale.

These graphs tell that the levels of the response curves for the keys A, B and C are noticeably higher than that for the key N in the frequency range between 1 kHz and 2 kHz. As the hammer strike exhibits a frequency characteristic (frequency components) as shown in FIG. 12, in which the curve level is roughly flat in the range from 10 Hz up to 3 kHz, it will be apparent that those differences are due to the vibration characteristics of the respective keys. It will be understood from these graphs that the nail clashing noises with the keys A, B and C sound piercingly sharp, because the vibrations of these keys includes more frequency components in the range of 1 kHz-2 kHz than the key N.

Figure 10:
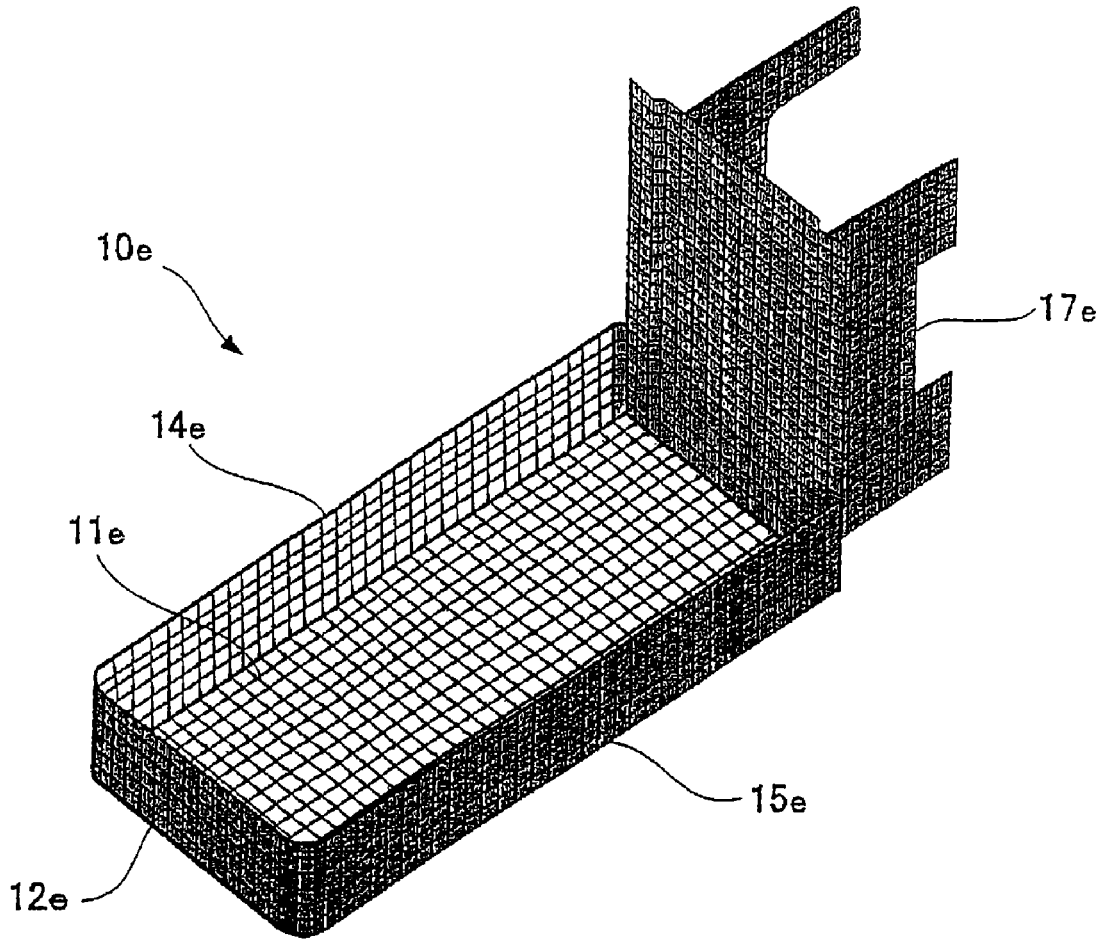
FIG. 10 is a perspective view for showing a simulation model for evaluating the vibration characteristics of a white key of a control model.
Figure 17:
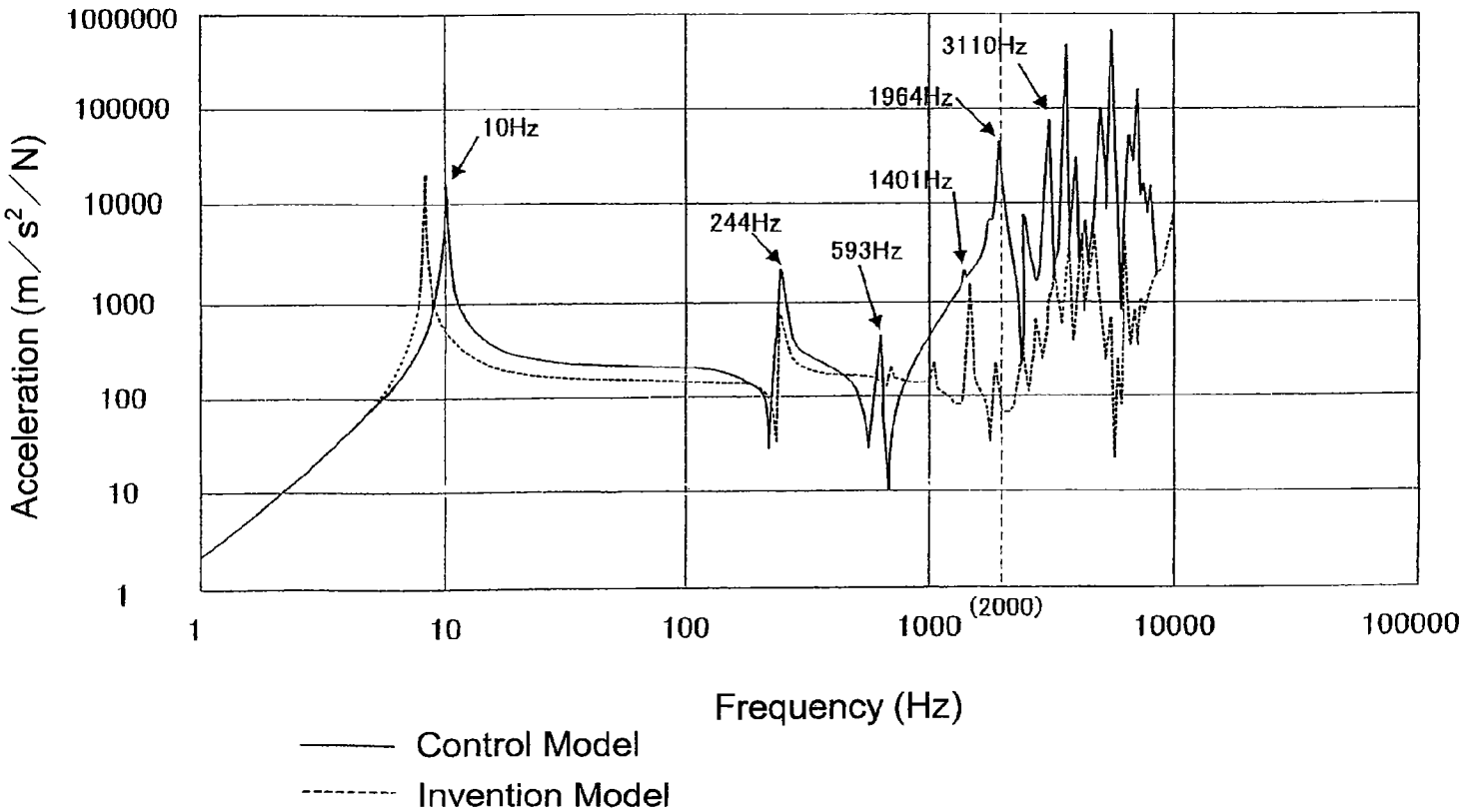
FIG. 17 is a graph showing two vibration characteristics analyzed of a white key having a small wall thickness and no rib as a control model and of a white key having a small wall thickness and a rib as an embodiment of the present invention.

(3) Analysis of the Vibration Characteristic of a Simulation Model of a White Key Having Thin Walls:

Taking the key A as an example model of a key having thin walls, a simulation model is created by a computer based on the dimensions, the shape and the material characteristics (Young's modulus, Poisson's ratio, density, etc.). FIG. 10 depicts, in a diagrammatic perspective view, a simulation model as viewed from the bottom, with the bottom side being directed upward. The numeral 10*e* denotes a key body consisting of abstracted parts of a wide part 11*e*, a front wall 12*e*, side walls 14*e*, 15*e* and an actuator 17*e*. Based on this simulation model, the vibration characteristics were analyzed using the Finite Element Method. The results of the analysis is shown in the graph of FIG. 17 by the solid line curve, with both the abscissa and the ordinate in a logarithmic scale. The measured peak frequencies of the actual key A and the analyzed peak frequencies of the simulation model of the key A are compared in Table 2.

TABLE 2

| Measurement in [Hz] | Analysis In [Hz] | Measurement/ Analysis |
|---|---|---|
| 184 | 10 | 18.40 |
| 280 | 244 | 1.15 |
| 736 | 593 | 1.24 |
| 1560 | 1401 | 1.11 |
| 1930 | 1964 | 0.98 |
| 4000 | 3110 | 1.29 |

Table 2 tells that the resonance peak frequencies of 244 Hz through 3110 Hz from the analysis are close to the resonance peak frequencies of 280 Hz through 4000 Hz from the measurements, respectively, in other words, the ratios of the "measured peak frequency/analyzed peak frequency" are close to "1" for each corresponding resonance peak. This means that the data obtained through the analysis of the simulation model will have a high degree of reliability in representing the actual model.

Figure 11:
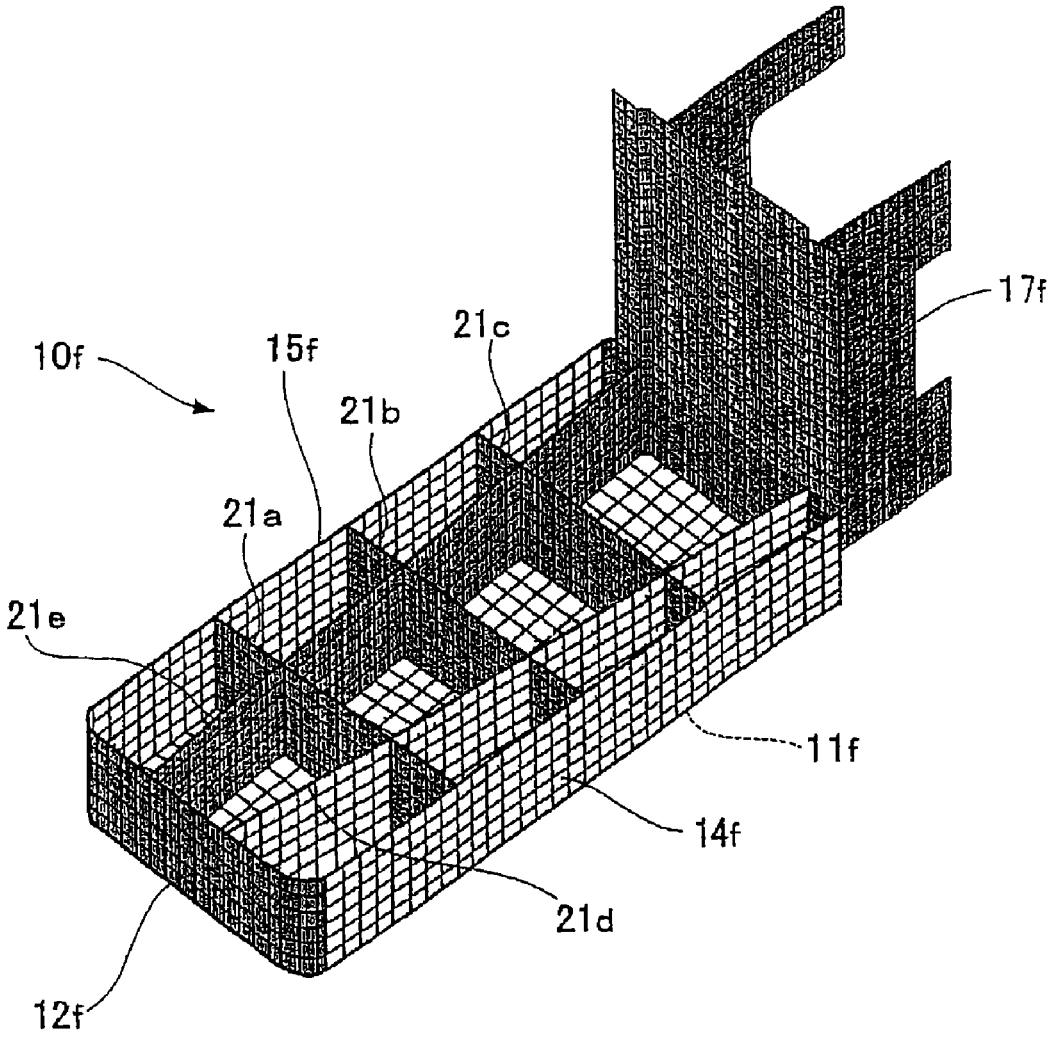
FIG. 11 is a perspective view for showing a simulation model for evaluating the vibration characteristics of a white key of an embodiment model according to the present invention.

(4) Analysis of the Vibration Characteristic of a Simulation Model of a White Key Having Thin Walls and Provided with a Projection:

FIG. 11 depicts, in a similar way as FIG. 10, a simulation model for the above-mentioned key A but additionally having a projection according to the present invention. In this simulation model, the key body 10*f* consists of abstracted parts of a wide part 11*f*, a front wall 12*f*, side walls 14*f*, 15*f* and an actuator 17*f*, and further of rib-shaped projections 21*a*, 21*b*, 21*c*, 21*d*, 21*e*. The projections 21*a*, 21*b*, 21*c* extend transversely in parallel with the front wall 12, each connecting the side walls 14*f* and 15*f*, and the projections 21*d*, 21*e* extend longitudinally, each connecting the front wall 12*f* and the front of the actuator 17*f*. In the description herein below, the simulation model of FIG. 10 of the key A is referred to as a control model and the simulation model of FIG. 11 of the key A provided with the projection is referred to as an invention model.

FIG. 17 shows the vibration characteristics of a white key having a small wall thickness and no rib as a control model (by a solid line curve) and of a white key having a small wall thickness and a rib as an invention model (by a dotted line curve) as analyzed by using the Finite Element Method. As will be apparent from the graph, the vibration level of the invention model is noticeably lower than that of the control model roughly in the frequency range of 1100 Hz through 2000 Hz. This means that the sharp nail clashing noises with the control model are conspicuously reduced with the invention model. This analysis proves that even a white key constituted by the walls of reduced thickness will not generate sharp annoying nail clashing noises, if a projection is provided in the wide part of the key.

The present invention should not be interpreted to be limited to the embodiments described herein above, but can be realized with various modifications. For example, the shape of the white key may be variously designed other than the above described embodiments. While a plurality of white keys may preferably be connected at their rear end to make an integral unit, the individual white keys may be separately designed and manufactured. The projection may be in the form of a rib or a column, and the number of projections may be singular or plural according to the intended characteristic. The description made herein above with respect to several embodiments will be applicable to other types of embodiments.

While several preferred embodiments have been described and illustrated in detail herein above with reference to the drawings, it should be understood that the illustrated embodiments are just for preferable examples and that the present invention can be practiced with various modifications without departing from the spirit of the present invention.

This application is based on, and claims priority to, Japanese Patent Application N. 2007-275338, filed on Oct. 23, 2007. The disclosure of the priority application, in its entirety, including the drawings, claims, and the specification thereof, is incorporated herein by reference.

What is claimed is:

1. A white key for a keyboard musical instrument comprising:

a key body made of resin in the form of a hollow box shape having an upper wall to be pressed by user and vertical walls extending downward from the periphery of the upper wall, wherein the upper wall of the key includes a wide part and a narrow part, the narrow part providing a space to accommodate a black key, and wherein the upper wall has a thickness not exceeding 1.5 mm and the wide part has a projection extending from the upper wall downward, the projection causing the upper wall to have a frequency band of a vibration mode due to a deformation of the upper wall when pressed by the user so that the frequency band is shifted from the frequency band of the vibration where the upper wall has no projection.

2. A white key for a keyboard musical instrument as claimed in claim 1, wherein the projection is in the form of a rib.

3. A white key for a keyboard musical instrument as claimed in claim 2, wherein the rib is integrally formed with the key body, lying in the longitudinal direction of the key body.

4. A white key for a keyboard musical instrument as claimed in 1, wherein the projection is provided to have the frequency band of the vibration mode due to a deformation of the upper wall when pressed by the user so that the frequency band is shifted toward the higher frequency side as compared with the case where the upper wall has no projection.

5. A white key for a keyboard musical instrument as claimed in claim 4, wherein the frequency of the vibration mode lies in the range of 1 kHz-2 kHz.

6. A white key for a keyboard musical instrument as claimed in claim 5, wherein the projection is formed to cause a decrease of an acceleration peak value of the vibration mode of the upper wall in the range between 1 kHz and 2 kHz.

* * * * *